United States Patent [19]

Flider

[11] 4,265,375

[45] May 5, 1981

[54] SAFETY DISPENSING APPARATUS FOR FLAMMABLE LIQUIDS

[75] Inventor: Frank S. Flider, Mattoon, Ill.

[73] Assignee: Justrite Manufacturing Company, Mattoon, Ill.

[21] Appl. No.: 944,585

[22] Filed: Sep. 21, 1978

Related U.S. Application Data

[63] Continuation-in-part of Ser. No. 752,397, Dec. 20, 1976, abandoned.

[51] Int. Cl.[3] ..... B67D 5/42

[52] U.S. Cl. ..... 222/189; 222/385; 417/554

[58] Field of Search ..... 222/189, 385, 380, 382; 417/554

[56] References Cited

U.S. PATENT DOCUMENTS

| | | | |
|---|---|---|---|
| 420,402 | 1/1890 | Benson | 222/189 |
| 740,221 | 9/1903 | Blackmon | 222/385 |
| 1,749,038 | 3/1930 | Langdon | 222/380 |
| 1,914,690 | 6/1933 | Hunt | 222/385 X |
| 2,577,417 | 12/1951 | Halpin | 222/385 |
| 2,764,317 | 9/1956 | Lisciani | 222/189 X |
| 3,131,639 | 5/1964 | Huigens | 222/385 X |

FOREIGN PATENT DOCUMENTS

| | | | |
|---|---|---|---|
| 630600 | 8/1927 | France | 222/385 |
| 415738 | 8/1934 | United Kingdom | 222/385 |
| 451734 | 8/1936 | United Kingdom | 222/385 |

*Primary Examiner*—Robert J. Spar
*Assistant Examiner*—Frederick R. Handren
*Attorney, Agent, or Firm*—Alter and Weiss

[57] ABSTRACT

Apparatus for safely dispensing flammable liquids from containers. A reciprocating piston, slidingly positioned within a cylinder, draws flammable liquid from a sealed drum and dispenses the liquid from a spout member extending from the apparatus. A flame-arresting device operably positioned within the apparatus disperses any flame advancing into the cylinder. A dip tube extends from the apparatus into the flammable liquid within the drum. In a preferred embodiment of the invention, the reciprocating piston dispenses flammable liquids on the upstroke only, thus preventing accidental or inadvertent discharge of the liquid.

2 Claims, 5 Drawing Figures

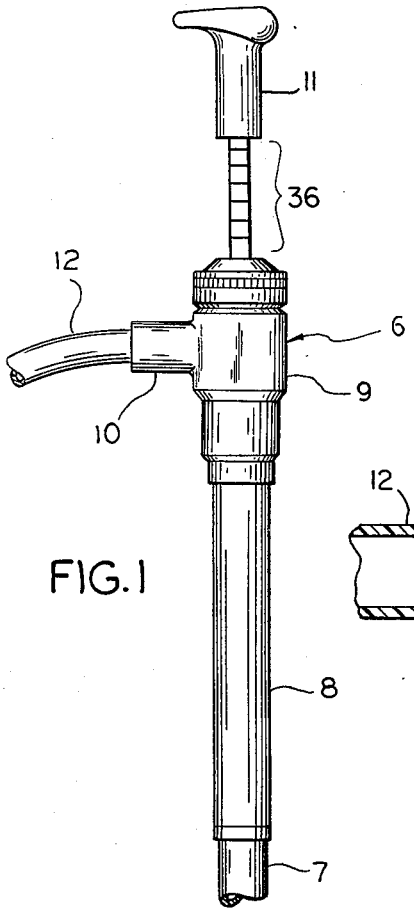
FIG. 1
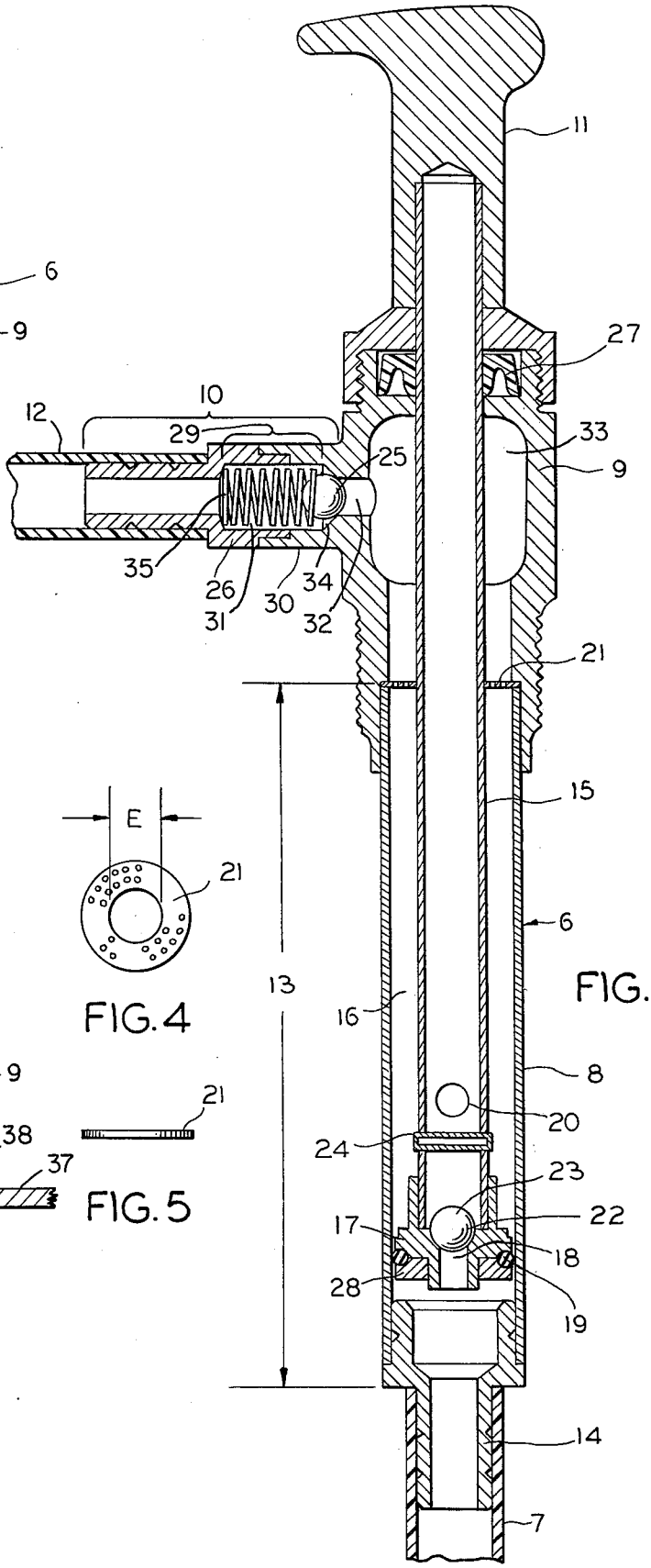
FIG. 2
FIG. 4
FIG. 5
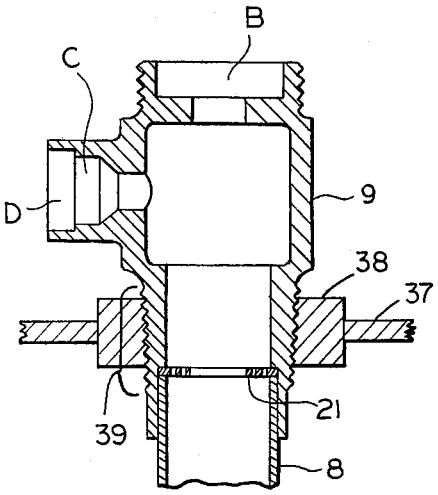
FIG. 3

SAFETY DISPENSING APPARATUS FOR FLAMMABLE LIQUIDS

The present invention relates generally to devices for containing and using flammable liquids and, in particular, to a safety dispensing apparatus for dispensing flammable liquids from containers. This is a Continuation-in-Part of my application Ser. No. 752,397, Dec. 20, 1976, since abandoned.

For literally hundreds of years, men have utilized a series of packaging devices to facilitate the storage and use of liquids. The advent of modern petro-chemicals, in particular, has resulted in increased transportation and storage of extremely hazardous volatile liquids. These hazards have been alleviated, to some degree, by the use of specially designed containers for flammable liquids. Frequently these containers are formed of sealed, non-metallic, molded plastic materials which resist corrosion, dents, cracks, and will not cause sparks when dropped. Substantially the same effect is achieved by utilizing plastic liners within metallic containers for flammable liquids.

A continuing problem exists, however, with the dispensing of flammable liquids from such containers, particularly where the liquids are extemely volatile or corrosive. Splashing or splattering of such liquids may promote the occurrence of fire, explosion and resultng serious personal injury. Thus, storage containers for such liquids should provide not only a safe receptacle for storage and shipment, but should also provide equally safe methods for controlledly dispensing flammable liquids. In addition, dispensing apparatus for such containers should prevent accidental discharge of flammable liquids from the container if it is overturned, or subjected to impact. Due to the high volatility of such flammable liquids, even a small amount of discharge could result in ignition of the contents of the container.

The greatest danger lies, however, in the possibility of accidental ignition of the flammable liquid within a safety container being ignited. Such an accident could turn the container into an explosive device, with resulting increase in danger to life and property. Therefore, it is imperative to prevent flames or sparks from reaching the liquid within the container.

Another serious problem is to precisely control the amount of liquid dispensed from the container. Any device for dispensing such flammable liquids from containers should make it as easy as possible to use the contents of a container in whatever quantity is desired.

An additional area of use that must be considered is the ability to direct the flow of flammable liquids from the container to a particular point, or to dispense the liquid over a wide area. In any such dispensing method, the flow of liquid from the container must be continuous and uniform, without surges or excessive turbulence, in order to avoid splashing or splattering; such turbulence also results in an increased hazard of ignition and should be avoided.

Previous devices used in dispensing flammable liquids from containers comprise, among others, pour spouts, nozzles, funnels, and hoses connected to the liquid container. All require lifting and tipping the liquid container in order to dispense the flammable liquid contained within. The size, shape, and weight of containers filled with liquids often make this operation somewhat difficult. A second difficulty has been posed in precisely controlling the volume of liquid dispensed. Frequently, separate, measured containers had to be utilized in order to control the amount dispensed. Similar problems are encountered in directing the flammable liquid to a specific point. The use of funnels and nozzles adequately overcame some of these problems, but utilization still proved difficult. Similarly, hoses effectively communicate the flammable liquid within the container to a specific point, but ease of use is still a problem.

One of the most successful devices used to dispense flammable liquids from containers comprises a piston-type apparatus fixedly engaged in one of the openings of a container of flammable liquids. These devices allow relatively precise amounts of the flammable liquid to be dispensed at a controlled speed and rate. However, several difficulties remain. Primary among these is the danger of ignition of flammable liquids outside the container, advancing through the pumping apparatus and into the container, causing an explosion. A second difficulty is the fact that the pumping apparatus dispenses liquid responsive to movement of the handle of the apparatus either upwards or downwards. This greatly magnifies the possibility of accidental discharge of the flammable liquid when moving the container from one point to another or when the container is tipped over or subjected to impact. A third problem is effective sealing of such pumping apparatus against leaks.

The present invention has, therefore, among others, the following objects:

To provide dispensing apparatus for dispensing liquids from containers, which include means for preventing the combustion of flammable liquids within the dispensing apparatus and within the container;

To provide safety dispensing apparatus which prevents the accidental discharge of flammable liquids from within containers, or from within the safety dispensing apparatus;

To provide safety dispensing apparatus for dispensing flammable liquids from a container, which is simple and easy to utilize, and does not require raising or tipping the container in order to dispense the flammable liquid contained within;

To provide safety dispensing apparatus for dispensing flammable liquids from containers which enables precise control of the amount of flammable liquid dispensed; and To provide a safety dispensing apparatus for dispensing flammable liquids from a container which prevents splashing, splattering, or turbulence of the liquid as it is dispensed from the container.

The present invention is an apparatus for safely dispensing flammable liquids from containers. The invention comprises a reciprocating piston slidingly positioned within a cylinder, means for preventing combustion of flammable liquids within the dispensing apparatus and within the container, a spout member to direct the discharge of liquids from the container, and a dip tube extending into the container from the apparatus to transport the liquid from the container to the apparatus.

The invention includes means for preventing the accidental discharge of flammable liquids from the container. In a preferred embodiment of the invention, means are operably positioned within the spout member to check the flammable liquid from escaping. Only when the reciprocating piston is drawn through an upstroke is sufficient pressure created to defeat the check means and allow liquids to be dispensed.

In a preferred embodiment of the invention, the cylinder containing the reciprocating piston, or pumping chamber, as it is called in the claims, is comprised of a substantially tubular main chamber connected at the top to a pump head. A head chamber disposed within the pump head serves as a connection between the pumping chamber and the spout member. At its bottom, the pumping chamber terminates in an end plug which connects to the dip tube. In this manner, a liquid flow path is completed between the safety dispensing apparatus and the liquid to be pumped.

In a preferred embodiment of the invention, the reciprocating piston slidingly positioned within the pumping chamber includes a piston to which a hollow pinton tube is attached. The piston has a passage formed therethrough to communicate liquids through it into the piston tube. Attached to the piston are means to provide a seal between the piston and the pumping chamber within which it is slidingly positioned. In a preferred embodiment of the invention, said sealing means includes an "O" ring having an outside diameter substantially equal to the inside diameter of the fluid cylinder, and a seal retainer.

Means are provided by the present invention to prevent combustion of flammable liquids. In a preferred embodiment, a flame arrestor is used, comprising a perforated disc positioned within the pumping chamber. Specifically, this perforated disc is disposed at the top of the pumping chamber, within the pump head, and is annular in shape to allow the piston tube to slide therethrough. The flame arrestor operates by dispersing any flame advancing from the spout member through the pump head and into the pumping chamber. In yet another embodiment of the invention, means are provided to prevent combustion of flammable liquids by closing off the fluid flow path through the spout member. A ball, of a diameter larger than that of the flow path formed through a portion of the spout member, is urged by a spring into position to close off said flow path.

In a preferred embodiment of the present invention, liquid is dispensed through the spout assembly only when the reciprocating piston is moved in an upstroke through the pumping chamber. The piston has an orifice formed therethrough, selectively closed off by a ball with an outside diameter greater than the diameter of the piston orifice. The upper portion of the orifice diminishes in diameter from top to bottom to form a seat for the ball. Consequently, the ball is seated in the piston orifice and prevents the escape of liquid past the piston when the piston is drawn upward. When the reciprocating piston is lowered through the pumping chamber, the piston ball is unseated, and liquid is allowed to travel from the downstream side of the piston to the upstream side. This movement allows liquid to enter the pumping chamber through a bypass formed in the wall of the piston tube.

Lowering the piston through the pumping chamber does not dispense liquid up into the pump head. If the container is accidentally tipped over and the reciprocating piston is moved through the pumping chamber, no flammable liquid is discharged, thus preventing the possibility of accidental ignition.

When the piston is drawn through an upstroke, and is extracted from the pumping chamber, the flammable liquid contained within the pumping chamber is forced upwards through the pump head and out the spout assembly. Liquid is prevented from moving back into the container during the upstroke of the piston ball which is seated in the piston orifice.

An additional feature of the invention is a spout assembly which extends from the pump head. The spout assembly remains stationary as the piston is moved, and may be positioned to direct the discharge of flammable liquids as desired. In one embodiment of the invention, a flexible spout tube is fixedly attached to the spout assembly so as to transport said flammable liquid to a desired point.

In yet another embodiment of the invention, a handle is fixedly attached to the upper end of the piston tube to effect the dispensing of flammable liquid from the safety dispensing apparatus. In a preferred embodiment of the invention, the handle is designed to facilitate extraction of the piston tube from the safety dispensing apparatus, thereby moving the piston through the pumping chamber. Particularly, the tip of the handle is designed for placement of two fingers to allow force to be exerted during the upstroke.

An additional feature of the invention, in a preferred embodiment, includes visual or mechanical methods to precisely determine the volume of liquid dispensed by a single stroke of the safety dispensing apparatus. This single stroke control is extremely useful in multiple fillings of containers of the same volume. These methods include, but are not limited to, a series of measurement gradations marked on the outside of the piston tube to display the precise quantity of flammable liquid extracted with each upstroke. An alternative, but not exclusive, method includes using pumping chambers of specified volumes. The user, upon ascertaining the precise quantity of liquid desired, selects a safety dispensing apparatus with a pumping chamber of the specified volume, inserts that apparatus into the container of flammable liquids, and proceeds to utilize the apparatus.

A better understanding of the features of the present invention may be had upon consideration of the accompanying drawings, in which:

FIG. 1 is a side perspective view of the apparatus showing the handle partially withdrawn therefrom;

FIG. 2 is a side sectional view of the apparatus;

FIG. 3 is a partial side sectional view of the apparatus illustrating the pump head;

FIG. 4 is a top plan view of the flame arrestor; and

FIG. 5 is a side view of the flame arrestor shown in FIG. 4.

While the present invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Referring to FIG. 1, reference numeral 6 refers generally to a safety dispensing apparatus for dispensing flammable liquids from containers. Dip tube 7 is fixedly attached to pumping chamber 8 and extends into the container from which liquid is to be drawn. Pump head 9 is attached to end plug 14 of pumping chamber 8, and directs liquids drawn through dip tube 7 via pumping chamber 8. Pump head 9 has spout assembly 10 attached thereto, which directs the discharge of flammable liquids from the safety dispensing apparatus 6.

In FIG. 2, handle 11 is shown in close juxtaposition with pump head 9, as would be seen when apparatus 6 is in a full downstroke position.

FIG. 1 shows handle 11 partially withdrawn from pump head 9.

As shown in FIG. 2, in a preferred embodiment of the invention, pumping chamber 8 is a substantially tubular chamber fixedly attached to and connecting with pump head 9, at one end, and an end plug 14, to which dip tube 7 is fixedly engaged, at the other end. Head 9, chamber 8, and end plug 14 are hollow, forming a liquid flow path from dip tube 7 to spout assembly 10.

Hollow piston tube 15 is slidingly maintained within pumping chamber 8, in a manner discussed hereinbelow. Annular fluid cavity 16 is thereby formed between piston tube 15 and the wall of pumping chamber 8. Piston 17 is fixedly attached to piston tube 15, and has orifice 18 formed therethrough, communicating with the hollow interior of piston tube 15. Seal 19, held by retainer 28, maintains a liquid-tight fit between piston 17 and pumping chamber 8.

When piston tube 15 is drawn from pumping chamber 8, a partial vacuum is created in dip tube 7 which extends into the container of flammable liquid. This vacuum draws liquid up through dip tube 7, and end plug 14, into pumping chamber 8, filling chamber 8 with liquid to be dispensed.

As seen in FIG. 2, piston tube 15 has bypass port 20 formed therethrough, to allow liquid to pass through piston orifice 18 and piston tube 15 into fluid cavity 16 when piston tube 15 is plunged into pumping chamber 8. Thereafter, during an upstroke piston 17, sealed on its sides by seal 19, forces the liquid from fluid cavity 16 into the pump head 9 and out through spout assembly 10. Ball retainer 24, prevents piston tube ball 23 from blocking bypass port 20.

FIG. 2, further discloses a check valve assembly 29 operably positioned within spout assembly 10 to prevent the accidental discharge of flammable liquids from apparatus 6. Spout assembly 10 includes spout socket 30 and spout projection 26, which mate to form check valve cavity 31. Throat 32 joins valve cavity 31 to pump head cavity 33, and is chamfered at 34 to provide a seat for ball 25. Spring 35 urges ball 25 to seat, thereby sealing off throat 32 and helping to prevent spillage should the liquid container to which apparatus 6 is attached be upset.

Flexible spout tube 12 may be slip-fitted onto spout projection 26 to allow precise direction of liquid, as desired.

FIG. 2 illustrates several means to prevent accidental combustion within apparatus 6 including placement of a perforated annular flame arrestor disc 21, within the fluid cavity 16, to disperse any flames which may enter fluid cavity 16, preventing such flames from igniting the flammable liquid within the container. Disc 21 also acts as a bearing point for piston tube 15, whereby tube 15 moves in a straight line when withdrawn from or plunged into pumping chamber 8.

FIG. 1 also discloses graduations 36 marked on the exterior of piston tube 15, to indicate the volume of liquid to be dispensed when handle 11, and thereby tube 15, is drawn upward. The specified volume obtained from a full stroke of piston tube 15 may be labeled on the safety dispensing apparatus 6 so that different dispensers may be used for different flow requirements. To vary the volume of liquid dispensed, length 13 of pumping chamber 8 may be changed, or the diameters of pumping chamber 8 and for piston tube 15 may be changed to vary the amount of liquid injected into cavity 16 with each downward stroke of piston tube 15.

Head seal 27 prevents liquids from leaking through the top of the safety dispensing apparatus 6 when piston 15 is inserted or withdrawn from pumping chamber 8, as well as if the container is tipped or upset.

FIG. 3 of the drawings shows the interior of pumping chamber 8 fixedly engaged with pump head 9. Operably positioned within pumping chamber 8 is flame arrestor 21. FIG. 3 shows, in particular, the interior of pump head 9 and spout socket 30. Specially noted are the space, B, provided for head seal 27, and spaces C and D, respectively, provided in spout socket 30, for check valve assembly 29 and spout projection 26.

FIG. 4 illustrates perforated flame arrestor 21, showing, in particular, aperture E, sized to telescopically receive piston tube 15, and giving flame arrestor 21 its characteristic annular appearance.

FIG. 5 of the drawings shows the relative thickness of flame arrestor 21.

Use of a preferred embodiment of the invention is perhaps best understood by the following description. Among other uses, the present invention is intended for use with a container such as a drum having a top 37 with a threaded bung hole 38, as schematically illustrated in FIG. 3. When liquids are stored within such a container, bung hole 38 is sealed off by a threaded plug, not herein illustrated. In order to adapt dispensing apparatus 6 for use with such containers, a portion 39 of the exterior of pump head 9 may be threaded, as illustrated at FIG. 3, with threads cut to match the threading most commonly found on typical bung holes such as 38.

When it is desired to dispense liquid from said container, the bung hole plug is unscrewed, and dispensing apparatus 6 is inserted through bung hole 38, with dip tube 7 extending below the surface of the liquid within the container, until threads 39 engage the threaded portion of bung hole 38. At that point, dispensing apparatus 6 may be rotated, thereby threadably securing it in bung hole 38.

In order to dispense liquid from the container, handle 11 must be drawn upward, moving piston tube 15, and thereby piston 17 upward through pumping chamber 8. The drawing upward of piston 17 creates a partial vacuum within pumping chamber 8, and thereby dip tube 7, drawing the liquid to be dispensed upward through dip tube 7, and the plug 14, and into pumping chamber 8. This vacuum is aided where the container is closed off during pumping operations.

At the peak of its upward stroke, piston 17 will be situated above the liquid level in pumping chamber 8. When handle 11 is depressed, and piston 17 forced through its downstroke, piston tube ball 23 will be unseated when piston 17 reaches the fluid level within pumping chamber 8, thereby enabling the liquid to be dispensed to enter hollow piston tube 15. Bypass port 20 enables the liquid entering piston tube 17 to fill fluid cavity 16, thereby providing a generally annularly-shaped segment of liquid. As handle 11 is again drawn upward, and piston 17 moved through a second upstroke, piston tube ball 23 will again seat within piston orifice 18, preventing the backflow of liquid down through end plug 14 and dip tube 7, as piston 17 is further drawn upward, the annular segment of liquid in fluid cavity 16 is forced through flame arrester 21, and into pump head cavity 33. The pressure exerted throughout said liquid segment by piston 17 will create a force sufficient to defeat check valve assembly 29 in spout assembly 10, by unseating check ball 25 in the direction of egress through spout assembly 10. In this manner, a portion of said liquid segment will be dispensed from apparatus 6, through spout assembly 10 and hose 12.

Dispensing apparatus 6 may be calibrated to indicate the volume of fluid dispensed for a given upstroke of piston 17. As illustrated at 36 in FIG. 1, piston tube 15 may have graduations formed externally thereon, indicating that a specified amount of liquid will be dispensed when handle 11 is drawn upwardly to a particular mark on piston tube 15.

Each such dispensing apparatus may be fashioned with a different pumping capacity, by increasing the length 13 of the pumping chamber, or, within the limits set by the size of bung hole 38, by changing the ratio of the diameters of pumping chamber 8 and piston tube 15 to alter the size of fluid cavity 16.

Thus, when dispensing apparatus 6 has been installed within a container having a bung 38, the sealed integrity of the container is maintained, both by check valve assembly 29, and piston seal 19. During dispensing operations, the vacuum created in the drum by the reciprocating motion of piston 17 may also be maintained by check valve assembly 29 and piston seal 19.

Dip tubes 7 of varying length may be supplied to accommodate variations in container size or liquid level within a given container.

Should handle 11 be left in an extended position, such as that encountered during an upstroke of piston 17, and should the container upon which dispensing apparatus 6 is mounted be accidentally upset, or should handle 11 be accidentally depressed, no liquid will be dispensed therefrom. Only when handle 11 is withdrawn from apparatus 6 will liquid be dispensed, providing a safety feature of considerable value. It is much less likely that handle 11 will be accidentally withdrawn than it will be accidentally depressed.

During dispensing operations, spout assembly 10 remains in a fixed position while handle 11 is operated through upstroke and downstroke, thus assuring steadier and more easily-controlled dispensing of liquids.

The foregoing description and drawings merely explain and illustrate the invention and the invention is not limited thereto, except insofar as the appended claims are so limited. It is expected that those skilled in the art who have the disclosure before them will be able to make modifications and variations therein without departing from the spirit scope of the invention.

I claim:

1. In a safety dispensing apparatus for dispensing flammable liquids from a container, said apparatus of the type having a reciprocating piston within a body, a piston rod attached at one end to said piston and at another end to a handle, said piston moveable by operating said handle through an upstroke and a downstroke, said apparatus defining a flow path for said liquids from said container, through said apparatus to a spout structure, the improvement comprising:

means positioned within said spout structure to check the flow of said liquid therethrough;

means operable to defeat said check means only when said handle is moved through said upstroke;

a liquid chamber positioned intermediate said spout structure and said piston, said piston fitting liquid-tightly within said chamber, wherein liquid is drawn into said chamber when said handle is moved through said downstroke, said defeat means including a one-way valve formed through said piston whereby liquid in said chamber may pass from upstream of said piston to downstream of said piston during said downstroke, but is prevented from flowing back when said handle is moved through said upstroke; and means to arrest combustion of said liquid within said chamber, said arresting means including an annular perforated disk positioned intermediate said spout structure and said piston, and said arresting means positioned about said piston rod.

2. In a safety dispensing apparatus for dispensing flammable liquids from a container, said dispensing apparatus of the type having a hollow body having two ends, a piston positioned slidingly therewithin, said piston in liquid-tight engagement with said hollow body, a spout structure terminating the first of said ends, a dip tube terminating the second of said ends, a piston rod attached at one end to said piston, and at the other end to a handle, whereby said piston may be moved through an upstroke and a downstroke within said body responsive to the upward and downward movement of said handle, said spout structure, said body, and said dip tube defining a flow path for said liquids from said container through said apparatus, the improvement comprising:

means positioned within said spout structure to positively seal off said flow path;

means to defeat said sealing means only when said piston is moved through said upward stroke; and means to arrest combustion of said liquids within said apparatus, said arresting means being positioned within said body intermediate said spout structure and said piston, said arresting means being formed as an annular perforated disk positioned coaxially with said piston rod, with said piston rod passing therethrough.

* * * * *